US009786457B2

(12) United States Patent
Ramsey

(10) Patent No.: US 9,786,457 B2
(45) Date of Patent: Oct. 10, 2017

(54) SYSTEMS AND METHODS FOR FREEWHEEL CONTACTOR CIRCUITS

(71) Applicant: General Electric Company, Schenectady, NY (US)

(72) Inventor: Stephan Robert Ramsey, Ballinasloe (IE)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 192 days.

(21) Appl. No.: 14/596,674

(22) Filed: Jan. 14, 2015

(65) Prior Publication Data

US 2016/0203931 A1 Jul. 14, 2016

(51) Int. Cl.
*H01H 47/04* (2006.01)
*H01H 47/06* (2006.01)

(52) U.S. Cl.
CPC ..... *H01H 47/04* (2013.01); *H01H 47/06* (2013.01)

(58) Field of Classification Search
CPC .... H01H 47/001; H01H 47/004; H01H 47/04; H01H 67/24
See application file for complete search history.

(56) References Cited

U.S. PATENT DOCUMENTS 4,734,817 A 3/1988 Baker et al.
5,557,494 A 9/1996 Ishikawa et al.
5,910,890 A 6/1999 Hansen et al.
7,781,943 B1 * 8/2010 Hamel ..... H02N 2/181 310/339
8,253,394 B2 8/2012 Hirst
8,508,905 B2 8/2013 Baek
2009/0190282 A1 * 7/2009 Wodniok ..... H01H 47/004 361/160
2010/0289603 A1 11/2010 Meid
(Continued)

FOREIGN PATENT DOCUMENTS

AU 2003261592 A1 3/2004
CN 101510485 A 8/2009
CN 101393819 4/2011
(Continued)

OTHER PUBLICATIONS

A European Search Report and Written Opinion issued in connection with corresponding EP Application No. 16150897.3 dated Jun. 14, 2016.

*Primary Examiner* — Thienvu Tran
*Assistant Examiner* — Tien Mai
(74) *Attorney, Agent, or Firm* — GE Global Patent Operation; Stephen G. Midgley

(57) ABSTRACT

A circuit for use with a contactor including at least one contact is provided. The circuit includes a first segment including a voltage source, a first coil, a second coil, and a first transistor, wherein the first segment is configured to selectively conduct a closing current through the first coil, the second coil, and the first transistor to close the at least one contact. The circuit further includes a second segment including the first coil, a second transistor, and a first diode, wherein the second segment is configured to selectively conduct a holding current through the first coil, the second transistor, and the first diode to hold the at least one contact closed, and wherein the first diode is arranged such that substantially all current produced by the voltage source flows through the first coil.

25 Claims, 3 Drawing Sheets

(56) References Cited

U.S. PATENT DOCUMENTS

| | | | |
|---|---|---|---|
| 2014/0043716 | A1 | 2/2014 | Hamond |

FOREIGN PATENT DOCUMENTS

| | | | |
|---|---|---|---|
| DE | 2305343 | A1 | 8/1974 |
| DE | 102006060059 | A1 | 7/2008 |
| EP | 0789378 | B1 | 2/2001 |
| EP | 0936649 | B1 | 5/2007 |
| EP | 2165408 | B1 | 1/2011 |
| EP | 2320438 | A1 | 5/2011 |
| KR | 20030081745 | | 10/2003 |

* cited by examiner

SYSTEMS AND METHODS FOR FREEWHEEL CONTACTOR CIRCUITS

BACKGROUND

The field of the invention relates generally to electrical contactors, and more particularly, a freewheel circuit for a contactor.

A contactor, or relay, is an electromagnetic device operable to selectively open and close one or more electrical contacts in response to a voltage applied to a coil in the contactor. FIGS. 1 and 2 are circuit diagrams of known contactor circuits 1 and 5, respectively.

In contactor circuit 1, in a quiescent state, a transistor 2 ("TR1") is turned off and a voltage at its collector is V1. When a positive control voltage V2 of a predetermined magnitude is applied to a base of transistor 2, the resultant current flow through a relay coil 3 from V1 to ground establishes an electromagnetic field in relay coil 3 that causes a contact 4 to close. At this point, most of the V1 voltage will be developed across relay coil 3 and the voltage on the collector of transistor 2 will be minimal. When the control voltage falls below a certain level, transistor 2 turns off and interrupts current flow through relay coil 3, causing collapse of the electromagnetic field and immediate opening of contact 4. However, the energy stored in relay coil 3 cannot be dissipated immediately, setting up a back EMF that results in a voltage substantially greater than V1 appearing on the collector of transistor 2. Depending on the rating of transistor 2, this voltage could result in the breakdown and/or failure of transistor 2.

This issue is overcome by the arrangement of contactor circuit 5, where a diode 6 has been connected in inverse parallel across relay coil 3. Under normal conditions, diode 6 is non-conducting. However, when transistor 2 is turned off, the voltage rise at the collector of transistor 2 will cause diode 6 to conduct and clamp the collector voltage to about 0.7 volts (V) above V1, preventing damage to transistor 2. However, current flow will be maintained in the current loop formed by relay coil 3 and diode 6, and this current flow will reduce relatively slowly over an indefinite period until such time as the energy in relay coil 3 has been sufficiently dissipated to open contact 4. This relatively slow dissipation results in a gradual opening of contact 4 instead of a sudden opening, which increases the risk of sustained arcing across contact 4 and resultant damage to contact 4. The issues of slow energy dissipation within contactor circuit 5 may be mitigated to some extent by using active components rather than diode 6 alone.

The current required to energize a contactor coil (e.g., relay coil 3) sufficiently to close the contacts (referred to as a closing current) is substantially greater than the current required to keep the contacts in the closed state (referred to as a holding current). Once the coil current falls below the holding current level, the contacts will open automatically. If energy stored in the coil is harnessed to maintain the contacts in the closed state for a certain period of time, it is possible to remove the closing current temporarily, restoring it at regular intervals. In effect, the closing current may be switched on and off at regular intervals, so long as the contacts are maintained in the closed state during the off periods. This reduces the mean external current required to maintain the contacts in the closed state.

FIG. 3 is a circuit diagram of a known freewheel circuit 10 that includes a first coil 12 ("L1") and a second coil 14 ("L2") in series with a first transistor 16 ("Q1"). A first voltage 18 ("V1") provides the closing current for the contactor. A second voltage 20 ("V2") provides a control voltage that is initially in the form of a steady state voltage operable to turn on first transistor 16. When first transistor 16 is turned on, a closing current flows in a first current loop 22 ("I1") through the series chain of first coil 12, second coil 14, first transistor 16, and a first resistor 24 ("R4"). First coil 12, a Darlington transistor pair 30 ("Q2"), and a first diode 32 ("D1") form a second current loop 34 ("I2"). Second coil 14, a second diode 40 ("D2"), and a first Zener diode 42 ("ZD1") form a third current loop 44 ("I3").

When current ceases to flow in third current loop 44, energy stored in first and second coils 12 and 14 will cause the voltage at the drain of first transistor 16 to rise substantially above V+. If left uninterrupted, this voltage rise may result in damage to first transistor 16. However, the voltage rise causes a pulse of current to flow through first diode 32, a capacitor 50, and emitters of Darlington pair 30 to V+, turning on Darlington pair 30. This results in a voltage drop across Darlington pair 30 of approximately 1V and starts circulation of current within second current loop 34 to maintain contactor contacts (not shown in FIG. 3) in the closed state and prevent escalation of the voltage on first transistor 16. As capacitor 50 acquires charge, the current flow to Darlington pair 30 from capacitor 50 will decrease. However, when the voltage across capacitor 50 exceeds a breakover voltage of a second Zener diode 52 ("ZD2"), current will be supplied to Darlington pair 30 through second Zener diode 52 to keep Darlington pair 30 on. At this stage, the voltage across Darlington pair 30 will rise to a level slightly higher than the breakover voltage of second Zener diode 52, thus clamping the voltage across Darlington pair 30 to this level.

The voltage rise across second coil 14 gives rise to a current in third current loop 44, and this voltage will be clamped by first Zener diode 42 and second diode 40 while the energy in second coil 14 is dissipated. When this current flows, first diode 32 and Darlington pair 30 are forward biased. When first transistor 16 turns on again, second coil 14 acts as a snubber coil to mitigate any risks of reverse break-over of first diode 32 and Darlington pair 30.

Second Zener diode 52 and a third diode 60 ("D3") clamp a voltage across Darlington pair 30 to facilitate preventing Darlington pair 30 from being stressed by relatively high voltages. For the clamping to work, however, capacitor 50 should be discharged to ensure it can pass a current pulse to Darlington pair 30 immediately after first transistor 16 is turned off. This is achieved by using a second resistor 62 ("R1") that provides a discharge path for capacitor 50. However, this results in power dissipation in third diode 60, second Zener diode 52, and second resistor 62, and also diverts current that could be flowing through first coil 12 to a parallel circuit, reducing the overall efficiency of circuit 10.

Further, the current in second current loop 34 may be relatively high (e.g., greater than 3 A) such that the power dissipation across Darlington pair 30 is relatively high (e.g., greater than 3 Watts (W)), requiring Darlington pair 30 to have a relatively high power rating. Moreover, when current is flowing through second current loop 34, the total power dissipation in Darlington pair 30 and first diode 32 may be relatively high (e.g., 5 W for a current of 3 A), reducing the overall efficiency of circuit 10.

BRIEF DESCRIPTION

In one aspect, a circuit for use with a contactor including at least one contact is provided. The circuit includes a first segment including a voltage source, a first coil, a second coil, and a first transistor, wherein the first segment is configured to selectively conduct a closing current through the first coil, the second coil, and the first transistor to close the at least one contact. The circuit further includes a second segment including the first coil, a second transistor, and a first diode, wherein the second segment is configured to selectively conduct a holding current through the first coil, the second transistor, and the first diode to hold the at least one contact closed, and wherein the first diode is arranged such that substantially all current produced by the voltage source flows through the first coil.

In another aspect, a system is provided. The system includes a contactor including at least one contact and a circuit. The circuit includes a first segment including a voltage source, a first coil, a second coil, and a first transistor, wherein the first segment is configured to selectively conduct a closing current through the first coil, the second coil, and the first transistor to close the at least one contact. The circuit further includes a second segment including the first coil, a second transistor, and a first diode, wherein the second segment is configured to selectively conduct a holding current through the first coil, the second transistor, and the first diode to hold the at least one contact closed, and wherein the first diode is arranged such that substantially all current produced by the voltage source flows through the first coil.

In yet another aspect, a method of assembling a circuit for use with a contactor including at least one contact is provided. The method includes electrically coupling a voltage source, a first coil, a second coil, and a first transistor together to form a first segment, the first segment configured to selectively conduct a closing current through the first coil, the second coil, and the first transistor to close the at least one contact. The method further includes electrically coupling the first coil, a second transistor, and a first diode together to form a second segment, the second segment configured to selectively conduct a holding current through the first coil, the second transistor, and the first diode to hold the at least one contact closed, wherein the first diode is arranged such that substantially all current produced by the voltage source flows through the first coil.

In yet another aspect, a method of operating a contactor circuit is provided. The contactor circuit includes a first segment having a voltage source, a first coil, a second coil, and a first transistor, and a second segment having the first coil, a second transistor, and a first diode. The method includes conducting a closing current through the first segment to close a contact associated with the contactor circuit, wherein the first diode is arranged such that substantially all current produced by the voltage source flows through the first coil, and conducting a holding current through the second segment to hold the contact closed.

DETAILED DESCRIPTION

Exemplary embodiments of a circuit for use with a contactor are provided. The circuit includes a first segment for selectively conducting a closing current to close at least one contact of the contactor. The circuit further includes a second segment for selectively conducting a holding current to hold the at least one contact closed. The second segment includes a diode arranged such that substantially all current produced by a voltage source in the first segment flows through a first coil of the first segment.

Figure 4:
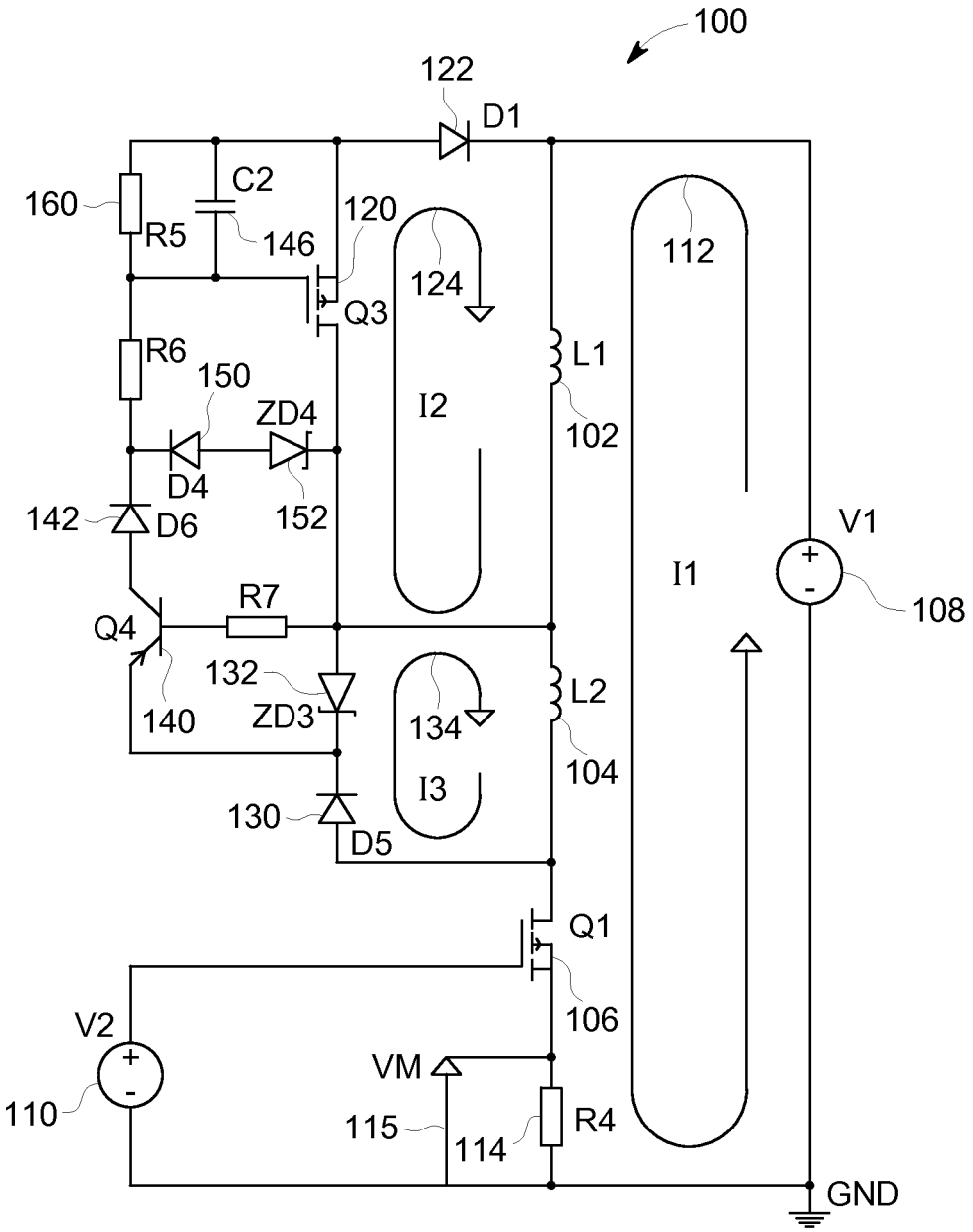
FIG. 4 is a circuit diagram of an exemplary freewheel circuit.

FIG. 4 is a circuit diagram of an exemplary freewheel circuit 100 for a contactor. Circuit 100 includes a first coil 102 ("L1") and a second coil 104 ("L2") in series with a first transistor 106 ("Q1"). First coil 102 operates as the main contactor coil as current flow through first coil 102 is used to close the contactor contacts (not shown in FIG. 4). In addition to acting as a snubber coil, second coil 104 is used to harness energy that can be utilized for a secondary function. Accordingly, the inductance value of second coil 104 may be optimized to enable it to perform a dual role.

A first voltage 108 ("V1") provides the closing current for the contactor. First voltage 108 is a difference between ground and a positive voltage, V+. A second voltage 110 ("V2") provides a control voltage that is initially in the form of a steady state voltage operable to turn on first transistor 106. In the exemplary embodiment, first transistor 106 is an n-channel metal-oxide-semiconductor field-effect transistor (MOSFET). Alternatively, first transistor 106 is any type of transistor that enables freewheel circuit 100 to function as described herein. When first transistor 106 is turned on, a closing current flows through a first current loop 112 ("I1"), or segment of circuit 100. Specifically, the closing current flows through the series chain of first coil 102, second coil 104, first transistor 106, and a first resistor 114 ("R4").

The closing current in first current loop 112 is of a sufficient magnitude to enable the contactor contacts to close and to remain closed within a certain range as long as sufficient current continues to flow. In that regard, the current through first current loop 112 acts as both a closing current and a holding current. Specifically, a third voltage 115 ("VM") across first resistor 114 is monitored to verify that the current through first current loop 112 has risen to a level sufficient to ensure closing of the contacts. When third voltage 115 reaches a predetermined level, it can be used to reduce or turn off second voltage 110. When second voltage 110 is reduced below a certain level, first transistor 106 turns off and current ceases to flow in first current loop 112. In the absence of further action, the contact would open at this point.

However, first coil 102, a second transistor 120 ("Q3"), and a first diode 122 ("D1") form a second current loop 124 ("I2"), or segment. In the exemplary embodiment, second transistor 120 is an n-channel MOSFET. Alternatively, second transistor 120 is any type of transistor that enables freewheel circuit 100 to function as described herein. Second coil 104, a second diode 130 ("D5"), and a first Zener diode 132 ("ZD3") form a third current loop 134 ("I3"), or segment. Notably, first diode 122 causes all current produced from first voltage 108 to flow through first coil 102. That is, first diode 122 prevents the current produced from first voltage 108 from flowing to any parallel circuits, thus ensuring that substantially 100% of this current is used for the closing operation in first coil 102. Accordingly, the closing current may be optimized for performing the closing function alone. In contrast, in circuit 10, at least some of the current produced by first voltage 18 flows in a parallel circuit to facilitate powering Darlington pair 30.

With first transistor 106 initially off, a continuous stream of positive pulses is applied to first transistor 106 to turn it on. The voltage that develops across second coil 104 resulting from the flow of current through second coil 104 is harnessed to turn on a third transistor 140 ("Q4"). In the exemplary embodiment, third transistor 140 is a PNP bipolar junction transistor (BJT). Alternatively, third transistor 140 is any type of transistor that enables freewheel circuit 100 to function as described herein.

Turning on third transistor 140 provides a conduction path for current derived from third current loop 134 to flow via second diode 130, third transistor 140, a third diode 142 ("D6") to charge a first capacitor 146 ("C2"). When the voltage on first capacitor 146 reaches a predetermined level (e.g., 4 Volts (V)), second transistor 120 will turn on, but this will not affect the closing current because of the blocking action of first diode 122. When first transistor 106 turns off, the energy stored in first coil 102 will give rise to a current in second current loop 124 to flow through first coil 102 by virtue of the fact that second transistor 120 has already been turned on and thereby establishes current in second current loop 124. In the absence of this, the contacts would open. As such, energy stored within second coil 104 is used to utilize the energy stored in first coil 102 to give rise to the flow of current through second current loop 124 to thereby maintain the contacts closed in the absence of the closing current in first current loop 112.

When second transistor 120 is in the on state, its on impedance will be relatively low (e.g., 10 milliohms (mΩ)). When second current loop 124 has a current of, for example, 3 amps (A), the power dissipated across second transistor 120 will be approximately 0.09 Watts (W), which is substantially less than the power dissipation across Darlington pair 30 of circuit 10 (shown in FIG. 3). Accordingly, the power loss in second current loop 124 is substantively less than the comparable power loss of loop 34 of FIG. 3. This reduced power loss allows current to flow in second current loop 124 for substantially a longer period than for the comparable circuit of FIG. 3, increasing the non-conduction time of the closing current in first current loop 112, with resultant savings in energy consumed. In addition, the stress across second transistor 120 is substantially less than the stress in the comparable component in circuit 10 (i.e., Darlington pair 30).

When the current in second current loop 124 starts to fall and approach a level sufficient to open the contactor contacts, the voltage across second transistor 120 will start to rise, but this voltage will be clamped by a third diode 150 ("D4"), and a second Zener diode 152 ("ZD4") that are biased in opposite directions. In circuit 10, the power loss of Darlington pair 30 is V*I2, where V is the voltage drop across Darlington pair 30. In contrast, in circuit 100, the power loss of second transistor 120 is $(I2)^2*R$, where R is the on impedance of second transistor 120. In effect, second transistor 120 behaves as a variable impedance when considering power losses. Accordingly, given that this impedance is generally very low with second transistor 120 turned on, the resultant losses are also very low. In addition to providing energy to turn on second transistor 120 and activating the flow of current through second current loop 124, second coil 104 also performs a snubber function.

During operation, the energy stored in first coil 102 will dissipate within a finite time, resulting in automatic opening of the contacts, but before the contacts can open, V2 is reapplied in a timely manner to turn on first transistor 106 again. V2 can be arranged to be a series of positive pulses with a predetermined duty cycle (e.g., 95%) at a certain frequency (e.g., 1 kilohertz (kHz)), and these pulses cause regular interruption of the closing current and establishment of holding current in second current loop 124. Vm may also be used to turn off any positive pulse of V2 early to reduce the duty cycle (e.g., to 75%). Reductions in the magnitude or duration of the flow of the closing current in first current loop 112 will result in a reductions of the energy used in circuit 100. For example, circuit 100 may utilize a closing current of 30 amps (A) to close the contacts but a current in second current loop 124 of only 3 A to keep the contacts closed. It follows that turning the closing current off for 25% of a given period would result in a significant reduction in energy. On the other hand, it is important that the time taken to open the contacts is controlled such that intentional opening of the contacts is not diminished. Suitable selection of components for first coil 102, first diode 122, second transistor 120, and first capacitor 146 facilitates this balance.

Figure 1:
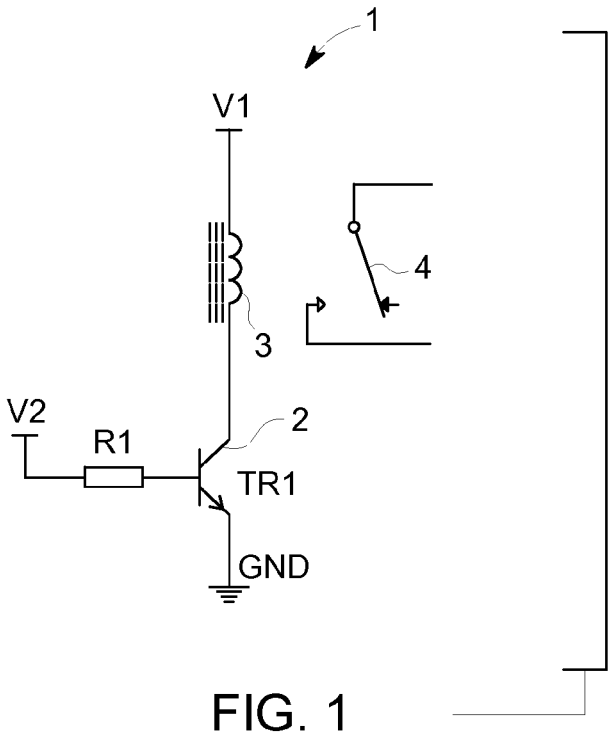
FIG. 1 PRIOR ART
FIG. 1 is a circuit diagram of a known contactor circuit.
Figure 2:
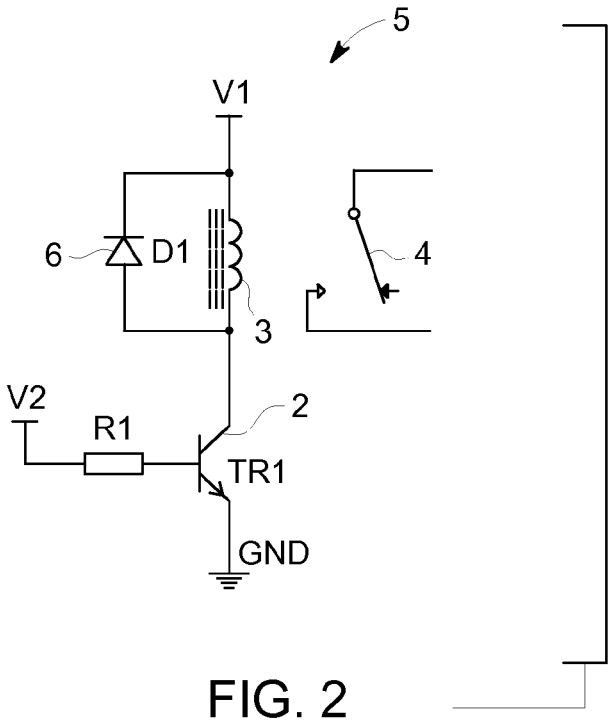
FIG. 2 PRIOR ART
FIG. 2 is a circuit diagram of a known contactor circuit.
Figure 3:
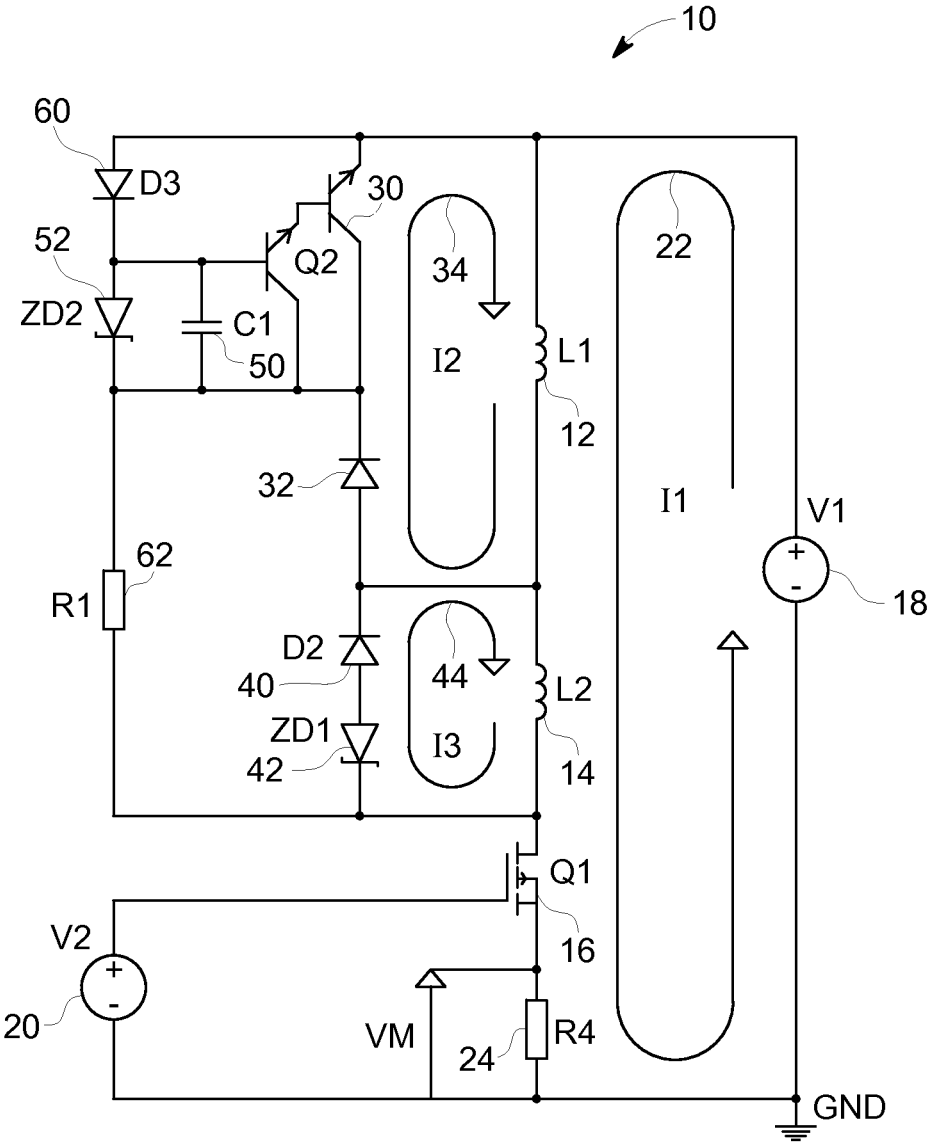
FIG. 3 PRIOR ART
FIG. 3 is a circuit diagram of a known freewheel circuit.

As compared to the known embodiment of FIG. 3, the exemplary embodiment of FIG. 4 has several advantages. Notably, in freewheel circuit 100, because first diode 122 is arranged to block any flow in a parallel path, there is no flow of current from V+ to ground via any parallel circuit. This makes freewheel circuit 100 more efficient than freewheel circuit 10. Further, when second transistor 120 turns on, its series impedance will be in the mΩ range and the power dissipated across second transistor 120 will be much less than the power dissipated across Darlington pair 30, resulting in reduced stress across that component and reduced losses within second current loop 124.

The total power dissipated across first transistor 120 and first diode 122 will be less than that of the total power dissipated across Darlington pair 30 and first diode 32. This reduced power loss will maintain the current in second current loop 124 at or above a holding current level for a longer period, thus reducing a duty cycle of the V2 pulse stream and improving overall efficiency. In effect, the stored energy in first coil 102 will keep the contactor contacts closed for a longer period of time in freewheel circuit 100 than in freewheel circuit 10.

In circuit 10, capacitor 50 turns on Darlington pair 30, and in circuit 100, first capacitor 146 turns on second transistor 120. However, first capacitor 146 is capable of operating at a substantially lower voltage and current than capacitor 50. Accordingly, first capacitor 146 may be a smaller and/or less expensive component than capacitor 50. As such, circuit 100 is more efficient and more reliable than circuit 10.

The arrangement of circuit 100 also provides for a controlled opening of the contactor contacts. Specifically, when V2 and first transistor 106 are turned off, the charge on first capacitor 146 will turn on second transistor 120 fully such that its initial impedance will be in the mΩ range and thus initiate the flow of the holding current. However, the energy in the third current loop 134 will dissipate relatively quickly and third transistor 140 will turn off. At this stage, the voltage at a point between first and second coils 102 and 104 will start to rise and second transistor 120 will start to turn off, but when the voltage at that point exceeds the breakover voltage of second Zener diode 152 there will be sufficient current flow to the gate of second transistor 120 through a resistor ("R6") to keep second transistor 120 on. Notably, the voltage rise across second transistor 120 will be clamped to the breakover voltage of second Zener diode 152 (e.g., 40V). Under this condition, energy will be dissipated in second current loop 124, and the contacts will open in a controlled and timely manner.

Circuit 100 is also more effective in limiting a maximum opening time of the controller contacts as compared to circuit 10. In circuit 10, a relatively large current (e.g., on the order of mA) is required to fully turn on Darlington pair 30 as determined by a gain of Darlington pair 30. In contrast, the current to turn on second transistor 120 is relatively small (e.g., on the order of μA). For the large turn on current of Darlington pair 30, capacitor 50 must be relatively large, and the charge on capacitor 50 must be dissipated through second resistor 62 after each pulse to enable capacitor 50 to deliver subsequent pulses to Darlington pair 30. This in turn creates power dissipation issues in second resistor 62. Accordingly, in circuit 10, Darlington pair 30, capacitor 50, and second resistor 62 must be relatively large to tolerate the stream of current pulses being supplied to the base of Darlington pair 30 and to dissipate power. In contrast, in circuit 100, second transistor 120, first capacitor 146, a second resistor 160, third diode 142, and third transistor 140 may have relatively low power ratings, as the gating current for second transistor 120 may be on the order of μA.

For a given holding current (e.g., 3 A), the maximum power dissipated in Darlington pair 30 will be approximately 3 W, whereas the maximum power dissipated in second transistor 120 will be approximately 0.1 W for the same holding current. Accordingly, the power rating of second transistor 120 may be substantially lower than that of Darlington pair 30, resulting in smaller component size and cost, and enhanced reliability. Alternatively, the lower power dissipation in second transistor 120 can accommodate a larger holding current, and therefore a larger contactor coil, etc.

In circuit 100, the voltage applied to first transistor 106 includes positive going pulses from the outset, and on/off periods of these pulses are monitored by VM and regulated. During each off period of V2, first transistor 106 is turned off, and the current through second current loop 124 is established. The on periods of V2 will be regulated automatically to facilitate optimizing the closing current to ensure closing of the contacts at any given value of V1. Thus, the ON periods of voltage V2 pulses will be automatically regulated so as to achieve the approximately the same mean value of the closing current needed to close the contacts for different values of V1.

Accordingly, the energy required to close the contacts will remain substantially the same for varying values of V1. Furthermore, because of the regulation of the closing current, V1 can be increased to a higher level (e.g., 3*V1) without any significant increase in power dissipated in first coil 102, second coil 104, first transistor 106, and first resistor 114. Thus, compared to circuit 10, circuit 100 enables a given contactor to be operated reliably and efficiently over a relatively wide operating voltage range.

As described herein, circuit 100 provides several advantages over at least some known contactor circuits. For example, energy is harnessed in second coil 104 to initiate the flow of a holding current in second current loop 124 when the closing current is turned off. Further, second transistor 120 is an active component with a relatively low on impedance, which facilitates realizing significant reductions in power loss that extends the duration of the holding current through second current loop 124. Further, using a FET as second transistor 120 facilitates the flow of the holding current, provides a controlled opening time of the contacts, and facilitates the use of low power components in circuit 100, thereby reducing the size, cost, and/or stress applied to the components. Circuit 100 also eliminates parallel paths to facilitate ensuring that approximately 100% of the current sourced from V1 flows in first coil 102, thereby increasing overall efficiency. Further, circuit 100 utilizes regulated control pulses to initiate the flow of the holding current during a closing operation so as to extend the operating voltage range of the contactor.

Exemplary embodiments of systems and methods for freewheel contactor circuits are described above in detail. The systems and methods are not limited to the specific embodiments described herein but, rather, components of the systems and/or operations of the methods may be utilized independently and separately from other components and/or operations described herein. Further, the described components and/or operations may also be defined in, or used in combination with, other systems, methods, and/or devices, and are not limited to practice with only the systems described herein.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A circuit for use with a contactor including at least one contact, said circuit comprising:

a first segment comprising:

a voltage source;

a first coil;

a second coil; and a first transistor, wherein said first segment is configured to selectively conduct a closing current through said first coil, said second coil, and said first transistor to close the at least one contact; and a second segment comprising:

said first coil;

a second transistor; and a first diode, wherein said second segment is configured to selectively conduct a holding current through said first coil, said second transistor, and said first diode to hold the at least one contact closed, and wherein said first diode is arranged such that all current produced by said voltage source flows through said first coil.

2. A circuit in accordance with claim 1, further comprising a third segment that comprises:

said second coil;

a second diode; and a first Zener diode, said third segment configured to conduct a current through said second coil, said second diode, and said first Zener diode in sequence.

3. A circuit in accordance with claim 2, further comprising a third transistor electrically coupled between said second diode and said second transistor.

4. A circuit in accordance with claim 3, wherein said third transistor comprises a PNP bipolar junction transistor.

5. A circuit in accordance with claim 1, wherein said voltage source, said first coil, said second coil, and said first transistor form a current loop.

6. A circuit in accordance with claim 1, wherein said first coil, said second transistor, and said first diode form a current loop.

7. A circuit in accordance with claim 1, wherein said second coil is configured to:

store energy when the closing current passes through said second coil; and discharge the stored energy to initiate a flow of the holding current in said second segment.

8. A system comprising:

a contactor comprising at least one contact; and a circuit comprising:

a first segment comprising:

a voltage source;

a first coil;

a second coil; and a first transistor, wherein said first segment is configured to selectively conduct a closing current through said first coil, said second coil, and said first transistor to close said at least one contact; and a second segment comprising:

said first coil;

a second transistor; and a first diode, wherein said second segment is configured to selectively conduct a holding current through said first coil, said second transistor, and said first diode to hold said at least one contact closed, and wherein said first diode is arranged such that all current produced by said voltage source flows through said first coil.

9. A system in accordance with claim 8, wherein said circuit further comprises a third segment comprising:

said second coil;

a second diode; and a first Zener diode, said third segment configured to conduct a current through said second coil, said second diode, and said first Zener diode in sequence.

10. A system in accordance with claim 9, further comprising a third transistor electrically coupled between said second diode and said second transistor.

11. A system in accordance with claim 10, wherein said third transistor comprises a PNP bipolar junction transistor.

12. A system in accordance with claim 8, wherein said voltage source, said first coil, said second coil, and said first transistor form a current loop.

13. A system in accordance with claim 8, wherein said first coil, said second transistor, and said first diode form a current loop.

14. A system in accordance with claim 8, wherein said second coil, is configured to:

store energy when the closing current passes through said second coil; and discharge the stored energy to initiate a flow of the holding current in said second segment.

15. A method of assembling a circuit for use with a contactor including at least one contact, said method comprising:

electrically coupling a voltage source, a first coil, a second coil, and a first transistor together to form a first segment, the first segment configured to selectively conduct a closing current through the first coil, the second coil, and the first transistor to close the at least one contact; and electrically coupling the first coil, a second transistor, and a first diode together to form a second segment, the second segment configured to selectively conduct a holding current through the first coil, the second transistor, and the first diode to hold the at least one contact closed, wherein the first diode is arranged such that all current produced by the voltage source flows through the first coil.

16. A method in accordance with claim 15, further comprising electrically coupling the second coil, a second diode, and a first Zener diode together to form a third segment, die third segment configured to conduct a current through the second coil, the second diode, and the first Zener diode in sequence.

17. A method in accordance with claim 16, further comprising electrically coupling a third transistor between the second diode and the second transistor.

18. A method in accordance with claim 17, wherein coupling a third transistor comprises coupling a PNP bipolar junction transistor.

19. A method in accordance with claim 15, wherein electrically coupling a voltage source, a first coil, a second coil, and a first transistor together comprises electrically coupling the voltage source, the first coil, the second coil, and the first transistor together such that the first segment forms a current loop.

20. A method in accordance with claim 15, wherein electrically coupling the first coil, a second transistor, and a first diode together comprises electrically coupling the first coil, the second transistor, and the first diode together such that the second segment forms a current loop.

21. A method of operating a contactor circuit that includes a first segment having a voltage source, a first coil, a second coil, and a first transistor, and a second segment having the first coil, a second transistor, and a first diode, the method comprising:

conducting a closing current through the first segment to close a contact associated with the contactor circuit, wherein the first diode is arranged such that all current produced by the voltage source flows through the first coil; and conducting a holding current through the second segment to hold the contact closed.

22. A method in accordance with claim 21, wherein conducting a holding current comprises conducting a holding current of approximately 3 amps.

23. A method in accordance with claim 22, wherein conducting a holding current comprising conducting a holding current such that approximately 0.1 Watts are dissipated in the second transistor.

24. A method in accordance with claim 21, wherein conducting a holding current comprises turning on the second transistor with an activation current on the order of microamps.

25. A method in accordance with claim 21, further comprising opening the contact by turning off the first transistor and dissipating energy in the second segment.

* * * * *